United States Patent [19]

Stumpff et al.

[11] Patent Number: 4,820,197

[45] Date of Patent: Apr. 11, 1989

[54] THREE-WAY SWITCH SYSTEM AND ADAPTER THEREFOR

[75] Inventors: Phillip W. Stumpff, Madill; Richard D. Taylor, Kingston, both of Okla.

[73] Assignee: Philrich Innovators Research Manufacturing and Development, Inc., Madill, Okla.

[21] Appl. No.: 130,140

[22] Filed: Dec. 8, 1987

[51] Int. Cl.[4] ..... H01R 9/24

[52] U.S. Cl. ..... 439/535; 439/721

[58] Field of Search ..... 439/214–216, 439/438, 439, 440, 441, 535, 709, 712, 721, 722; 174/53, 59

[56] References Cited

U.S. PATENT DOCUMENTS

| | | | |
|---|---|---|---|
| Re. 29,513 | 1/1978 | Johnson | 339/112 R |
| 2,671,204 | 3/1954 | Hubbell | 339/59 |
| 2,705,785 | 4/1955 | Benander | 339/164 |
| 2,725,544 | 11/1955 | Strange | 339/95 |
| 2,738,482 | 3/1956 | Benander | 339/164 |
| 2,743,423 | 4/1956 | Parks | 339/21 |
| 2,753,538 | 7/1956 | Carlson | 339/164 |
| 2,795,677 | 6/1957 | Slater | 200/166 |
| 2,873,433 | 2/1959 | Despard | 339/95 |
| 2,875,424 | 2/1959 | Hubbell | 339/164 |
| 2,890,436 | 6/1959 | Bentley | 339/258 |
| 3,001,168 | 9/1961 | Smith | 339/164 |
| 3,030,479 | 4/1962 | Ehrlich et al. | 200/168 |
| 3,097,906 | 7/1963 | Shannon | 339/253 |
| 3,165,614 | 1/1965 | Carissimi et al. | 200/166 |
| 3,323,099 | 5/1967 | Spera | 339/192 |
| 3,324,447 | 6/1967 | Pistey | 339/95 |
| 3,339,170 | 8/1967 | Martin | 339/31 |
| 3,393,397 | 7/1968 | Manichl | 339/95 |
| 3,451,037 | 6/1969 | Herrli | 339/192 |
| 3,532,846 | 10/1970 | Schumacher | 200/166 |
| 3,569,911 | 3/1971 | Bogdanowicz | 339/95 |
| 3,585,570 | 6/1971 | Jans | 339/95 |
| 3,652,811 | 3/1972 | Barney | 200/5 EB |
| 3,717,840 | 2/1973 | Vaughan et al. | 229/198 R |
| 3,828,113 | 8/1974 | Bourne | 174/55 |
| 3,885,852 | 5/1975 | Grove | 339/95 D |
| 3,916,149 | 10/1975 | Skinner | 219/335 |
| 3,922,478 | 11/1975 | Perkey | 174/53 |
| 3,936,126 | 2/1976 | Miller | 339/95 D |
| 3,945,711 | 3/1976 | Hohorst et al. | 339/95 D |
| 4,012,100 | 3/1977 | Viscosi | 339/95 D |
| 4,106,835 | 8/1978 | Kimm | 339/95 D |
| 4,165,443 | 8/1979 | Figart et al. | 174/53 |
| 4,166,934 | 9/1979 | Marrero | 200/51 R |
| 4,210,772 | 7/1980 | Magana et al. | 174/59 |
| 4,295,018 | 10/1981 | Borrelli | 200/51.09 |
| 4,336,418 | 6/1982 | Hoag | 174/53 |
| 4,420,215 | 12/1983 | Tengler | 339/176 R |
| 4,609,898 | 9/1986 | Seymour et al. | 335/202 |
| 4,627,675 | 12/1986 | Taylor | 439/535 |

FOREIGN PATENT DOCUMENTS 963217 7/1964 United Kingdom .

*Primary Examiner*—Neil Abrams

*Attorney, Agent, or Firm*—Laney, Dougherty, Hessin & Beavers

[57] ABSTRACT

A three-way switch wiring system and adapter therefor. The system includes an adapter having a pair of prongs which are engageable with first and second power contact strips in a wiring apparatus or junction box. The adapter includes an insulating housing with first and second common contact strips, a normally open contact strip and a normally closed contact strip therein. The contact strips and housing have wire receiving openings therein for receiving the wires of a pair of three-wire cables from first and second three-way switches. The wires on the cable from the first switch are connected to the first common contact strip and the normally open and normally closed contact strips, and the cable from the second switch is connected to the second common contact strip and the normally and normally closed contact strips. Sockets are disposed in the housing around the sets of wire receiving openings for wedging engagement with an outer insulating sheath of the cables. The housing has a protruded portion thereon adjacent the prongs, and the protruded portion extends into a socket in the wiring apparatus or junction box when the prongs are engaged with the first and second power contact strips. A representative three-way wiring circuit is also disclosed.

26 Claims, 5 Drawing Sheets

THREE-WAY SWITCH SYSTEM AND ADAPTER THEREFOR

BACKGROUND OF THE INVENTION

1. Field Of The Invention

This invention relates to three-way switch wiring systems for use in the wiring system of a house or other building, and more particularly, to a three-way switch wiring system having plug-in type components including an adapter for connecting two three-way switches to a wiring apparatus, such as a junction box.

2. Description Of The Prior Art

When a new building is being wired or an older building is being rewired, considerable time must be spent in making electrical connections with conventional junction, switch and receptacle boxes, and considerable time must also be spent in mounting such boxes. This is particularly true for a three-way switch wiring circuit which includes in addition to the device to be wired, such as a light or electrical receptacle, two switches and frequently a junction box. Accordingly, a need exists for electrical components with which various conductors may be quickly electrically connected in order to provide the electrical circuitry. In particular, a need exists for a system in which two three-way switches may be quickly connected to a wiring apparatus, such as a junction box which is in turn connected to the device to be switched.

The prior art includes wiring systems having plug-in type connections, such as seen in U.S. Pat. No. 4,165,443 to Figart et al.

Other examples of various forms of electrical connection apparatus, including plug-in type connectors, and in some instances some of the other general structural and operational features of the present invention, include U.S. Pat. Nos. 3,885,852; 3,339,170; 3,393,397; 3,451,037; 3,569,911; 3,717,840; 3,828,113; 4,012,100; and 4,106,835.

In spite of the numerous attempts which have been made to develop a practical alternative to conventional junction, switch and receptacle boxes, some of which attempts are shown by the above-cited references, none of these attempts has succeeded in providing a system which has found widespread acceptance in the marketplace. There is still the need for such improvement in plug-in type systems, and in particular for three-way switch wiring systems, and the present invention addresses such needs.

Further, there is a need for an electrical wiring apparatus which utilizes easily manufactured parts and facilitates assembly thereof. The improvements in the present invention provide electrical wiring components which include conventionally manufactured parts which are quickly assembled.

SUMMARY OF THE INVENTION

The three-way switch circuit of the present invention comprises a junction box or wiring apparatus and an adapter for interconnecting the junction box or wiring apparatus with a pair of three-way switches.

The wiring apparatus or junction box comprises a first power contact strip adapted for receiving a first wire from a power cable, a second power contact strip spaced from the first power contact strip, and a neutral or common contact strip adapted for receiving a second wire from the power cable. The wiring apparatus or junction box may also include a ground contact strip adapted for receiving a ground wire from the power cable.

The adapter comprises a first common contact strip adapted for receiving a wire from a common terminal of a first three-way switch, a second common contact strip adapted for receiving a wire from a common terminal of a second three-way switch, a normally open contact strip adapted for receiving wires from normally open terminals of the first and second three-way switches, a normally closed switch contact strip adapted for receiving wires from normally closed terminals of the first and second switches, and first and second strip engaging means. The first strip engaging means is adapted for providing electrical communication between the first power contact strip in the wiring apparatus or junction box and the first common contact strip in the adapter. The second strip engaging means is adapted for providing electrical communication between the second power contact strip in the wiring apparatus or junction box and the second common contact strip in the adapter.

In the preferred embodiment, the first strip engaging means is characterized by a first elongated prong adapted to extend from the first common contact strip through a wire receiving strip opening in the first power contact strip, and the second strip engaging means is characterized by an elongated second prong adapted to extend from the second common contact strip through a wire receiving strip opening in the second power contact strip.

The wiring apparatus or junction box further comprises an insulating box housing in which the first and second power contact strips, neutral contact strip, and ground contact strip, if any, are disposed. The box housing defines a recessed socket therein with wire receiving housing openings therethrough in registry with the wire receiving strip openings in the first and second power contact strips.

The adapter further comprises an insulating adapter housing in which the first and second common contact strips, the normally open switch contact strip, and the normally closed switch contact strip are disposed. The adapter housing has a protruded portion thereon adjacent the first and second strip engaging means. The protruded portion is adapted to extend into the socket in the box housing when the first and second strip engaging means extend through the wire receiving strip openings for engagement with the first and second power contact strips.

In the preferred embodiment, the first and second common contact strips also define a wire receiving strip opening therein, and the normally open and normally closed switch contact strips define at least a pair of wire receiving strip openings therein. The wire receiving strip opening in the first common contact strip is aligned with one of the wire receiving strip openings in each of the normally open and normally closed contact strips, and the wire receiving strip opening in the first common contact strip is preferably aligned with the other of the wire receiving strip openings in each of the normally open and normally closed switch contact strips.

The adapter housing preferably defines a plurality of wire receiving housing openings therein adapted for receiving the wires from the switches therethrough, each of the wire receiving housing openings being aligned with a wire receiving strip opening. The adapter housing defines a first socket adjacent the housing openings corresponding to the wire receiving strip openings on the first common contact strip and one of the wire receiving strip openings on the normally open and normally closed contact strips. The adapter housing further defines a second socket adjacent the housing openings corresponding to the wire receiving strip opening on the second common contact strip and the other of the wire receiving strip openings on the normally open and normally closed contact strips. Each of the sockets is dimensioned for wedging engagement with an outer insulating sheath of a three-wire cable.

Stated in another way, the adapter comprises an insulating housing defining a plurality of sets of wire receiving housing openings disposed through one wall thereof, a first common electrical contact strip disposed in the housing and having a wire receiving strip opening therein in registry with a wire receiving housing opening of one of the sets of wire receiving housing openings, a second common electrical contact strip disposed in the housing and having a wire receiving strip opening therein in registry with a wire receiving housing opening of the other of the sets of wire receiving housing openings, a first switch electrical contact strip disposed in the housing and having a plurality of wire receiving strip openings in registry with a corresponding wire receiving housing opening of each of the sets of wire receiving housing openings, a second switch electrical contact strip disposed in the housing and having a plurality of wire receiving strip openings in registry with a corresponding wire receiving housing opening of each of the sets of wire receiving housing openings, first strip engaging means in electrical communication with the first common electrical contact strip and extending through another wall of the housing for engaging an electrical contact strip in the junction box, and second strip engaging means in electrical communication with the second common electrical contact strip and extending through the same walls of the first strip engaging means for engaging another electrical contact strip in the junction box.

Each of the contact strips comprises a metal web portion through which the corresponding wire receiving strip opening is disposed and first and second leg portions extending from the web portion. The leg portions are arranged for grippingly receiving wire therebetween. In the embodiment in which the first and second strip engaging means are characterized by a pair of prongs, the first and second leg portions of the first and second common contact strips are further arranged for grippingly receiving an end of the corresponding prongs therebetween. The prong is spaced from the wire receiving strip opening in the corresponding common contact strip, and one of the leg portions in the common contact strips defines a transverse slot therein between the corresponding prong and wire receiving strip opening, such that the leg portion having the slot therein may flex to grippingly engage a wire of a different size than the prong.

In the adapter, the common contact strips are preferably substantially parallel, and the switch contact strips are substantially parallel. The common contact strips are preferably substantially perpendicular to the switch contact strips.

An important object of the present invention is to provide a quickly connected plug-in three-way switch circuit.

Another object of the invention is to provide a three-way switch adapter having means for engaging a wiring apparatus, such as a junction box, and adapted for receiving cables for providing electrical communication with at least a pair of switches.

A further object of the invention is to provide a three-way switch adapter which is adapted for grippingly receiving the wires of a pair of three-wire cables, each cable being connected to a three-way switch.

Other objects and advantages of the invention will become apparent to those skilled in the art when the following detailed description of the preferred embodiment is read in conjunction with the drawings which illustrate such preferred embodiment.

DETAILED DESCRIPTION OF THE PREFERRED EMBODIMENT

Figure 1:
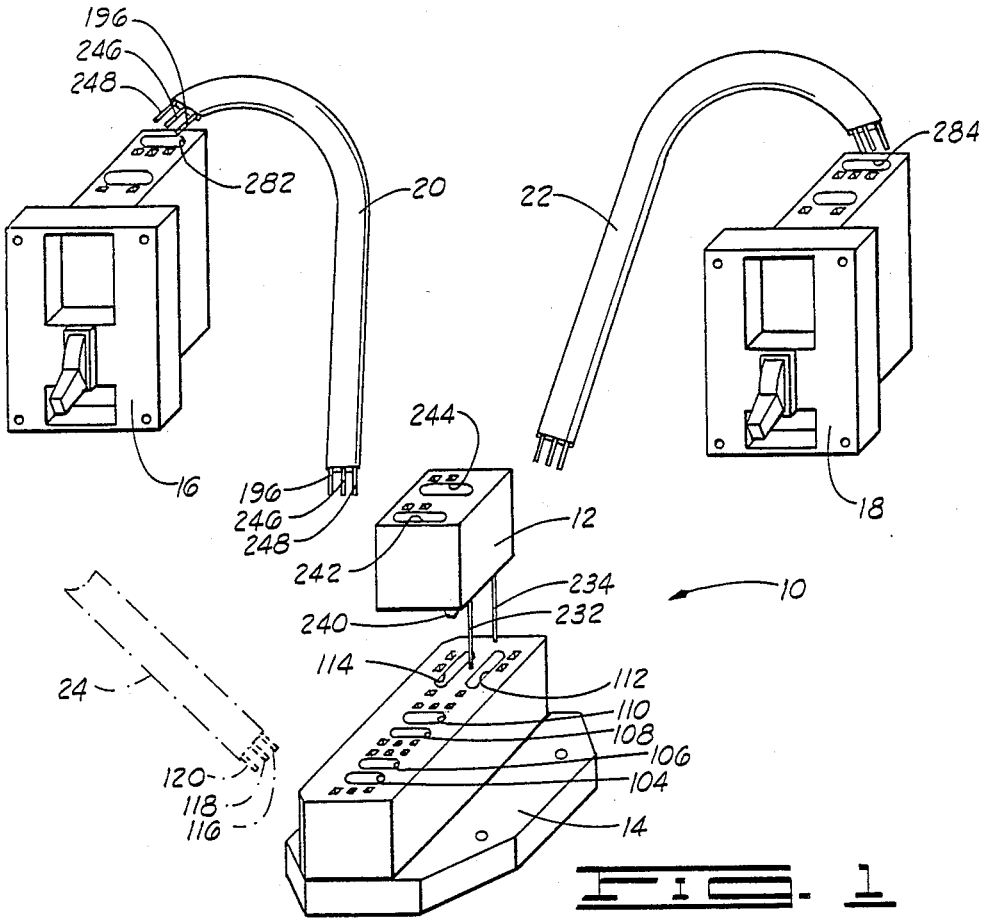
FIG. 1 is a perspective of the three-way switch wiring system of the present invention.

Referring now to the drawings, and more particularly to FIG. 1, the three-way switch wiring system of the present invention is shown and generally designated by the numeral 10. System 10 includes an adapter 12 which is adapted for plugging into an electrical wiring apparatus, such as junction box 14, as hereinafter described in more detail. Also forming a part of system 10 are a first three-way switch 16 and a second three-way switch 18. First and second switch cables 20 and 22 interconnect first and second switches 16 and 18, respectively, to adapter 12. A power cable 24 may be connected to junction box 14. Cables 20, 22 and 24 are three wire conductors of a kind known in the art. The plug-in connection of the cables into the various components will be discussed in more detail herein.

Referring now to FIGS. 2–7, one embodiment of junction box 14 is shown. This embodiment is substantially the same as one embodiment of the apparatus disclosed in co-pending U.S. patent application Ser. No. 939,185. However, the invention is not intended to be limited to the particular wiring apparatus shown herein, and other junction boxes or similar devices, such as the other embodiments shown in Application Ser. No. 939,185 and in U.S. Pat. No. 4,627,675, may also be used.

Figure 2:
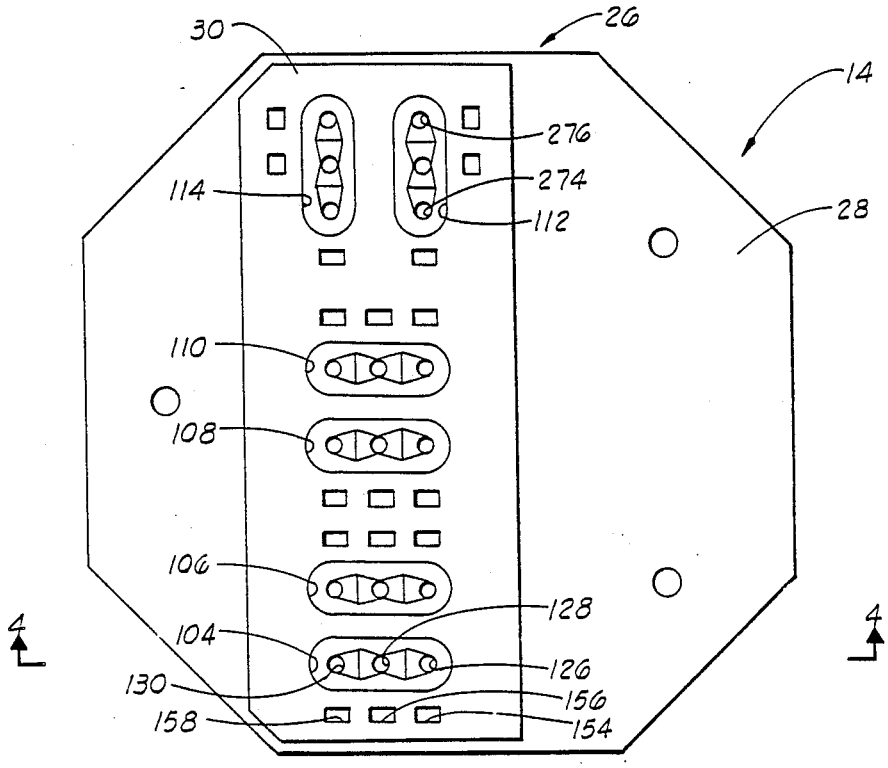
FIG. 2 is a plan view of an electrical wiring apparatus, such as a junction box, used in the wiring system.
Figure 3:
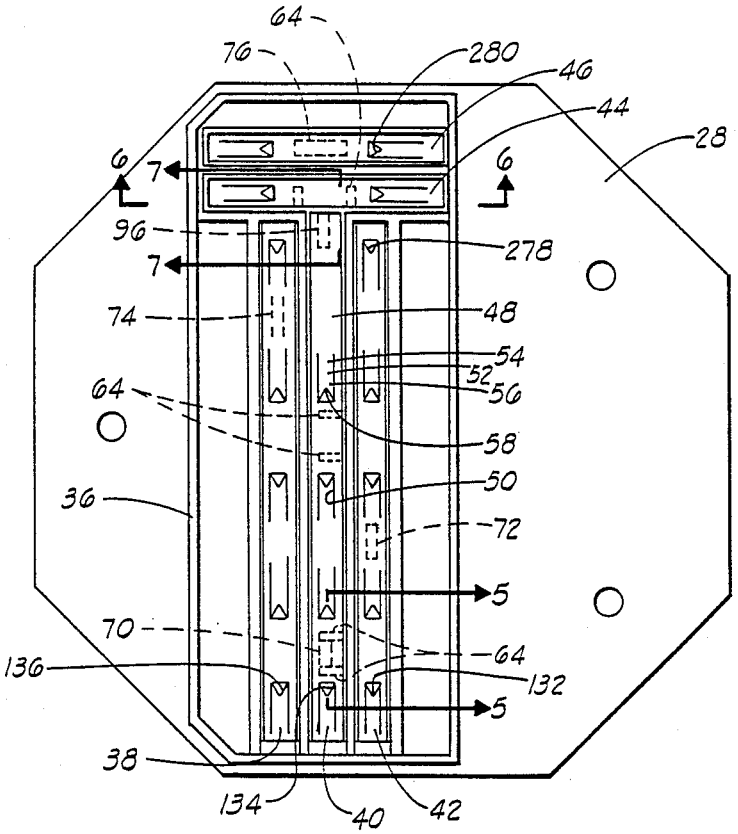
FIG. 3 is a plan view of the junction box with an upper housing portion removed.
Figure 4:
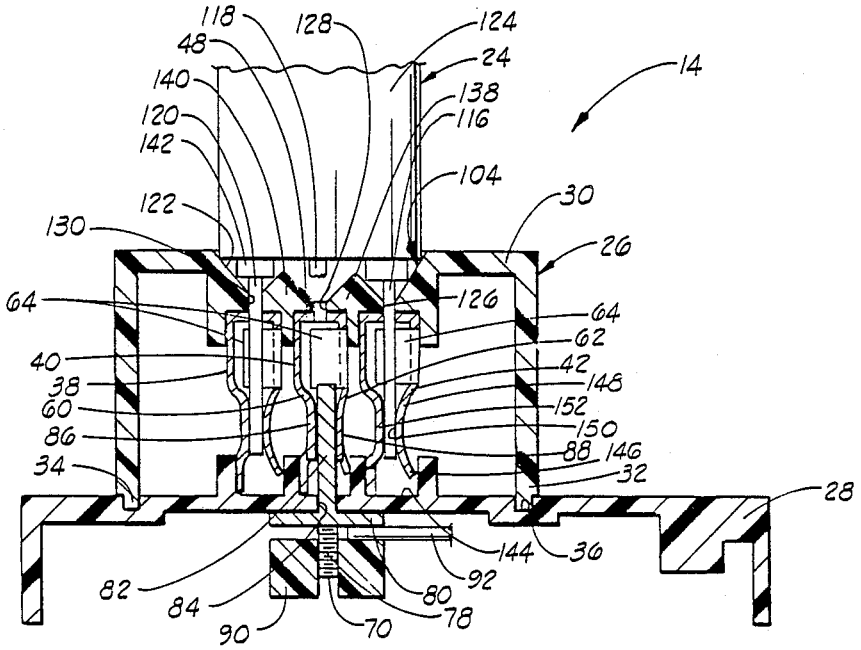
FIG. 4 is a cross section taken along lines 4—4 in FIG. 2.

As seen in FIG. 2, junction box 14 includes an outer box housing 26 formed by lower housing portion 28 and an upper housing portion 30. Referring also to FIGS. 3 and 4, upper housing portion 28 has an outer wall 32 with a narrow lip 34 thereon which is received in groove 36 of lower housing portion 28.

Disposed in housing 26 are five electrical contact strips 38, 40, 42, 44 and 46. Strip 38 is referred to as a common or neutral contact strip 38. Strip 40 is referred to as a ground contact strip 40. Strip 42 is referred to as a power contact strip 42. Strip 44 is referred to as a ground extension contact strip 44. Strip 46 is referred to as a switched power strip 46. As shown in FIG. 3, strips 38, 40 and 42 are elongated and parallel to one another. Strips 44 and 46 are also elongated, but are somewhat shorter than strips 38, 40 and 42. Strips 44 and 46 are oriented parallel to one another and perpendicular to strips 38, 40 and 42.

Figure 5:
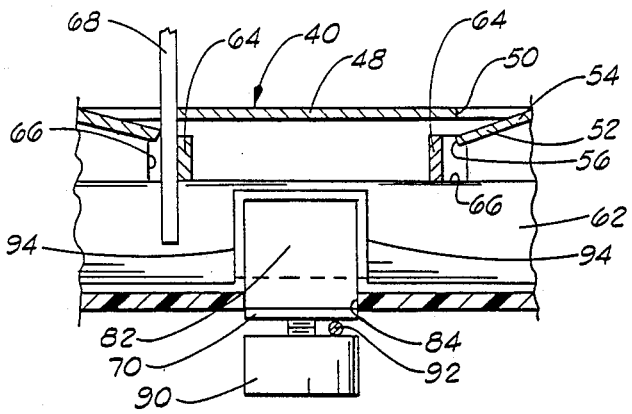
FIG. 5 shows a fragmentary cross-sectional view taken along lines 5—5 in FIG. 3.

Each of strips 38, 40, 42, 44 and 46 are similarly constructed, and the general construction of any one of the strips will be described with particular reference to the ground contact strip 40. Strip 40 has a first end which includes a middle web portion 48 having wire receiving strip or web openings 50 disposed therethrough. As best seen in FIGS. 3 and 5, each strip or web opening 50 is formed by punching a resilient tab 52 from web 48.

Each of resilient tabs 52 has a fixed end 54 and a free end 56 with a V-shaped notch 58 disposed therein.

Referring also to FIG. 4, contact strip 40 further includes first and second elongated leg portions 60 and 62 extending downwardly from web portion 48 toward lower housing portion 28, arranged to engagingly receive a wire therebetween.

Each of contact strips 38, 40, 42, 44 and 46 includes a plurality of inwardly directed shoulders 64 which extend substantially perpendicularly inwardly from one of first or second leg portions 60 or 62. As illustrated herein, shoulders 64 extend from second leg portions 62, but it will be seen that shoulders 64 could extend equally well from first leg portion 60. Shoulders 64 are illustrated only on contact strips 40 and 44 in FIG. 3, but it should be understood that similar shoulders are also present on contact strips 38, 42 and 46.

Referring now also to FIG. 5, each shoulder 64 is formed by punching the shoulder from the flat upper portion of second leg portion 62. In this way, a window 66 is formed in second leg portion 62. Window 66 has no other function than being the result of the formation of shoulders 64. Each shoulder 64 is spaced from, and generally faces, free end 56 of each tab 52 in all of the contact strips. Tab 52 may be further described as a wire retaining means for engaging and retaining a wire 68 inserted through web opening 50. Tab 52 acts to resist withdrawal of the wire from web opening 50 as already described herein. Shoulder 64 provides a means for an increased area of electrical contact between the wire and the contact strip.

Referring still to FIGS. 4 and 5, one embodiment of an electrically conductive terminal 70 is shown. Terminal 70 corresponds to ground contact strip 40. Terminal 70 is also indicated in FIG. 3 as are terminals 72, 74 and 76 which correspond to strips 42, 38 and 46, respectively.

Each of terminals 70, 72, 74 and 76 is identical in construction, so that the following description of terminal 70 is applicable to each of the other terminals 72, 74 and 76. Terminal 70 has a first end with a threaded stud 78 extending downwardly and away from a radially outwardly directed flange 80.

On the opposite side of flange 80 from stud 78 is a second end with an upwardly extending, elongated member in the form of a substantially flat blade 82. Blade 82 is adapted to extend through, and closely fit within, a slot 84 in lower housing portion 28. The positioning of blade 82 in slot 84 may be a pressfit, or alternatively, terminal 70 may be cemented in place so that it is fixedly attached to lower housing portion 28.

Blade 82 of terminal 70 extends between a clamping portion 86 of first leg portion 60 and a facing clamping portion 88 of second leg portion 62 of contact strip 40. Clamping portions 86 and 88 are substantially planar areas stamped from first and second legs 60 and 62, respectively. Clamping portions 86 and 88 define an aperture therebetween and are adapted for flat, gripping contact with blade 82 of terminal 70. This engagement of blade 82 with first and second leg portions 60 and 62 acts to hold contact strip 40 in place, and thus a retaining means is provided for retaining strip 40 in relationship to lower housing portion 28.

Terminal 70 is electrically conductive so that flange portion 80 of terminal 70 is thereby in electrical communication with contact strip 40. Similarly, terminals 72, 74, and 76 engage, retain and provide electrical contact with, contact strips 40, 38 and 46, respectively, as will be clear from a study of FIG. 3. No terminal is engaged with contact strip 44.

It will be seen that blade 82 of terminals 70, 72, 74 and 76 provide good electrical contact between leg portions 60 and 62 of the corresponding contact strips. Also, the width of blade 82 results in a good locking force for locking the contact strips in position in lower housing portion 28.

A nut 90 is threadingly engaged with stud 78. An electrical conductor 92 may be placed between nut 90 and flange 80, and the nut tightened to clamp the conductor therebetween. Thus, electrical communication is provided between conductor 92 and flange 80, and therefore between conductor 92 and contact strip 40.

The formation of clamping portions 86 and 88 forms a pair of narrow, transverse slots 94 in second leg portion 62 of contact strips 40. Slots 94 allow clamping portions 86 and 88 to flex separately from the rest of first and second leg portions 60 and 62 so that any difference in the size of the wires to be engaged and blades 82 does not affect the gripping action by the contact strip on the wires.

Figure 6:
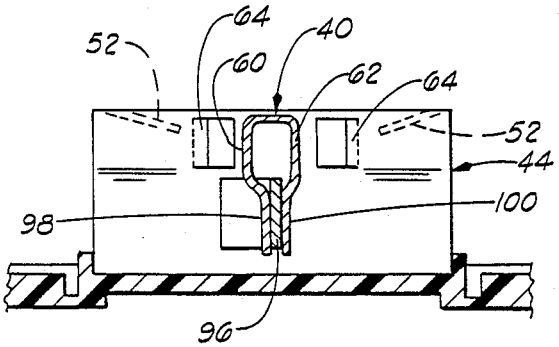
FIG. 6 is a partial cross-sectional view taken along lines 6—6 in FIG. 3.
Figure 7:
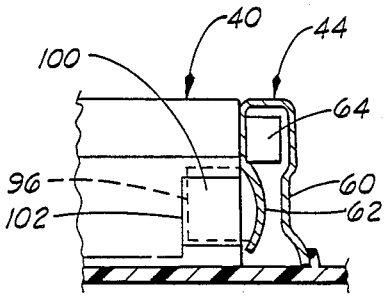
FIG. 7 shows a partial cross section taken along lines 7—7 in FIG. 3.
Figure 8:
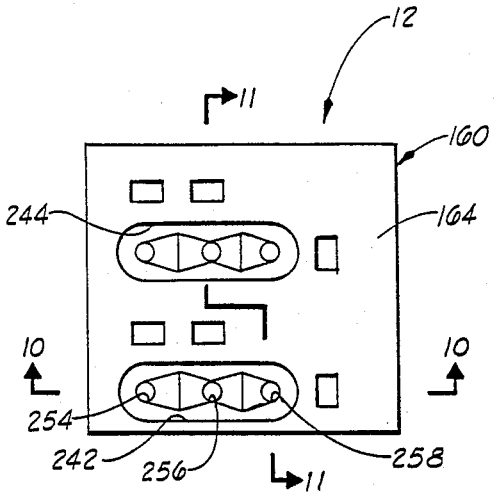
FIG. 8 is a plan view of the three-way switch wiring adapter of the present invention.

Referring now to FIGS. 3, 6 and 7, one embodiment of the engagement between ground contact strip 40 and ground extension contact strip 44 is shown. In this embodiment, an engagement plate 96 extends toward contact strip 40 and into an aperture between leg portions 60 and 62 thereof. Adjacent plate 96 a substantially flat clamping portion 98 is stamped from first leg portion 60, and a corresponding flat clamping portion 100 is stamped from second leg portion 62 of ground contact strip 40. Flat clamping portions 98 and 100 are positioned opposite one another and spaced to grippingly receive plate 96 therebetween so that ground extension contact strip 44 is attached to ground contact strip 40. Thus, ground extension contact strip is held physically in place, and electrical contact is provided between contact strips 40 and 44. In this way, plate 96 acts as a key means, and clamping portions 98 and 100 along with the aperture therebetween provide a key receiving means.

The formation of clamping portions 98 and 100 form a transverse narrow slot 102 along one side thereof.

Thus, clamping portions 98 and 100 are free to flex separately from the rest of first and second leg portions 60 and 62 of electrical contact strip 40 for compensating for variations in the size of plate 96 and any wires clamped by the electrical contact strip. The configuration of clamping portions 98 and 100 and plate 96 provide good electrical contact between strips 40 and 44. Referring again to FIG. 2, upper housing portion 30 has six cable-receiving external sockets 104, 106, 108, 110, 112, and 114, each of which is substantially identical in construction. Each of sockets 104, 106, 108, 110, 112 and 114 is constructed for use with a three wire conductor or cable as already mentioned. For example, socket 104 which is shown in partial cross section in FIG. 4, is adapted for use with power cable 24. Cable 24 is a three-wire conductor having wires 116, 118 and 120. The following description of socket 104 is applicable to each of the sockets.

Socket 104 is defined by a side wall 122 which is convergingly tapered toward the bottom of the socket. Tapered side wall 122 wedgingly engages outer casing 124 of cable 24. At the bottom of socket 104 are first, second and third aligned housing openings 126, 128 and 130, respectively, disposed therethrough. Housing openings 126, 128 and 130 are in registry with V-notch 126 of power contact strip 42, V-shaped notch 128 of ground contact strip 40, and V-notch 136 of common contact strip 38, respectively, as shown in FIG. 3. Similarly, the three housing openings in each of the other sockets 106, 108, 110, 112 and 114 are in registry with V-notches in the corresponding contact strips located therebelow, which can be readily determined by a comparison of FIGS. 2 and 3.

Socket 104 further includes first and second tapered mid walls 138 and 140, respectively. Tapered walls in socket 104 are thus also adapted to receive an inner insulating sheath, such as 142 which is shown wedgingly engaged with tapered mid wall 140 and tapered side wall 122. It will be obvious that each of openings 126, 128 and 130 have adjacent tapered walls for wedging engagement with similar insulating sheaths.

When cable 24 is inserted into socket 104, wires 116, 118 and 120 are correspondingly inserted into wire receiving housing openings 126, 128 and 130. Wires 116, 118 and 120 are grippingly engaged by first and second leg portions 60 and 62 of contact strips 42, 40 and 38, respectively. The following discussion with be directed toward the gripping engagement of wire 116 by contact strip 42, but it should be understood that the gripping engagement of the other wires by the corresponding contact strips is the same.

The lower end of first leg portion 60 of contact strip 42 engages lower wall 44 of lower housing portion 28. Second leg portion 62 has a lower free end 146 which is spaced above wall 144.

Second leg portion 62 is a flexible leg portion and is constructed so that it is flexed upon insertion of wire 116 between first and second leg portions 60 and 62 of contact strip 42. As second leg portion 62 is flexed upon insertion of wire 116, lower free end 146 thereof slides downwardly toward wall 144. A lower portion 148 of second leg portion 62 is arcuate in cross section and has a convex side 150 facing first leg portion 60. First leg portion 60 has a planar part 152 which is adjacent and offset toward arcuate portion 148 of second leg portion 62.

When a wire is inserted between first and second leg portions 60 and 62, it is grippingly engaged between convex side 150 of arcuate portion 148 of second leg portion 62 and planar part 152 of first leg portion 60. As noted above, such a wire 116 is engaged with power contact strip 42.

As wire 116 is inserted between first and second leg portions 60 and 62, first leg portion 60 remains relatively fixed, since its lower end engages wall 144, and the arcuate portion 148 of second leg portion 62 flexes by flattening the arc thereof. This causes second leg portion 62 to be resiliently biased against wire 116 so that it pushed against the wire and accordingly pushes the wire against planar part 152 of first leg portion 60.

Due to the large flat area of planar part 152, a large area of electrical contact is provided between wire 116 and first leg portion 60. Wire 116 also bears against shoulder 64 of contact strip 42, and thus further electrical contact is provided, as already described.

When cable 24 is inserted into socket 104, it is very snugly held therein by a combination of the already described resilient gripping action of strips 42, 40 and 38 on wires 116, 118 and 120, respectively, in combination with the wedging action of casing 124 with tapered side wall 122, and the wedging action of the inner sheaths, such as sheath 142, between the other tapered walls.

Transverse slots, similar to slots 94 already described are provided in second leg portion 62 of each of the contact strips between adjacent wire receiving web openings 50 as needed. These slots thus divide each arcuate portion 148 of each second leg portion 62 into different sections. These sections between adjacent slots thus may flex separately to compensate for varying thicknesses in wire size.

Referring once again to FIG. 2, each housing opening, such as 126, 128 and 130, has associated therewith a generally square or rectangular opening such as 154, 156 and 158, respectively. Openings 154, 156 and 158 extend through upper housing portion 30 and provide access for a tool to engage adjacent resilient tabs 52 near their fixed ends 54, so that the resilient tabs may be deflected downwardly to release the respective wires received through openings 126, 128 and 130.

Referring now to FIGS. 8–11, the construction of adapter 12 of the present invention is shown. Adapter 12 includes an outer adapter housing 160 formed by a lower housing portion 162 and an upper housing portion 164. Upper housing portion 162 has an outer wall 166 with a narrow lip 168 on opposite portions thereof which is received in grooves 170 of lower housing portion 162.

Disposed in housing 160 are four electrical contact strips 172, 174, 176 and 178. Contact strip 172 is referred to as a first common contact strip 172. Strip 174 is referred to as a second common contact strip 174. Strip 176 is referred to as a first, normally open switch contact strip 176. Strip 178 is referred to as a second, normally closed switch contact strip 178. The terms "normally open" and "normally closed" do not refer to any structure of contact strips 176 and 178 themselves, but rather refer to corresponding terminals to which they are preferably connected on three-way switches 16 and 18, as discussed further herein.

Figure 9:
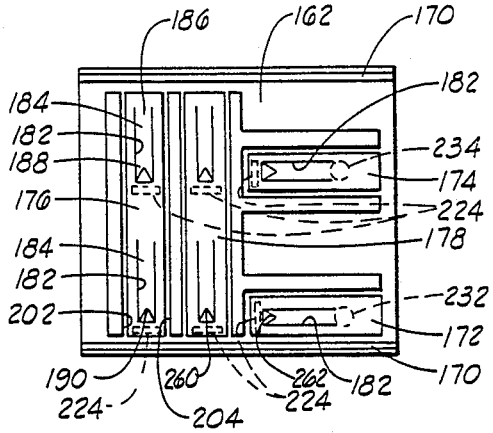
FIG. 9 shows a plan view of the adapter with an upper housing portion removed.

Contact strips 172 and 174 are elongated and disposed parallel to one another. Contact strips 176 and 178 are also elongated and disposed parallel to one another. Further, contact strips 176 and 178 are substantially perpendicular to contact strips 172 and 174, as best seen in FIG. 9.

Each of strips 172, 174, 176 and 178 are constructed similarly to strips 38, 40, 42, 44 and 46 in junction box 12. For example, normally open contact strip 176 has a first end which includes a middle elongated web portion 180 having a pair of wire receiving strip or web openings 182 disposed therethrough. As best seen in FIG. 9, each strip or web opening 182 is formed by punching a resilient tab 184 from web 180. Tab 184 may be further described as a wire retaining means for engaging and receiving a wire inserted through web opening 182 and for resisting withdrawal of such a wire from the web opening as previously described.

Each of resilient tabs 184 has a fixed end 186 integrally attached to web portion 180 and a free end 188. Free ends 188 are deflected downwardly from web portion 180. Free ends 188 of resilient tabs 184 have V-notches 190 disposed therein for engaging the wire.

Figure 10:
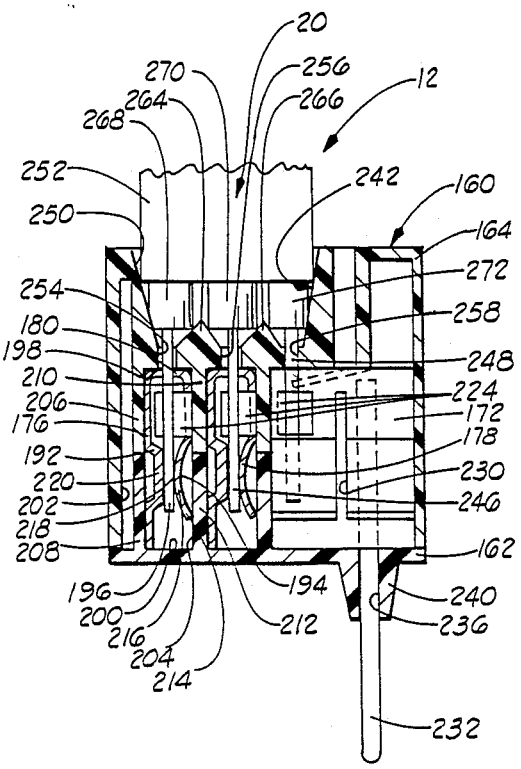
FIG. 10 is a cross section taken along lines 10—10 in FIG. 8.

Each contact strip further includes first and second elongated leg portions 192 and 194 extending downwardly from web portion 180 toward lower housing portion 164. First and second leg portions 192 and 194 are arranged to engagingly receive a wire therebetween. As seen in FIG. 10, such a wire 196 is engaged with normally open contact strip 176.

Figure 11:
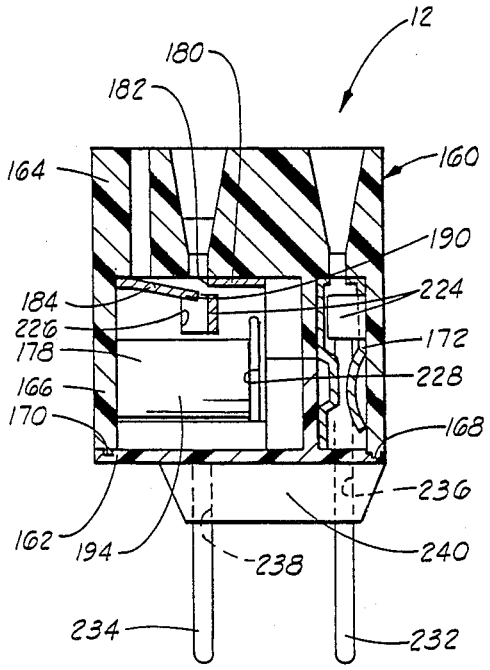
FIG. 11 is a cross-sectional view taken along lines 11—11 in FIG. 8.

Referring to FIGS. 9–11, it will be seen that each of strips 172, 174, 176 and 178 is disposed in a groove in housing 160. With particular reference to contact strip 176, strip 176 is disposed in a groove defined by an upper first wall 198 on upper housing portion 164, a lower second wall 200 on lower housing portion 162, and opposed third and fourth walls 202 and 204 extending at least partially between first and second walls 198 and 200. Third wall 202 has first and second separate portions 206 and 208, integrally formed on upper and lower housing portions 164 and 162, respectively. Similarly, fourth wall 204 has first and second separate portions 210 and 212, integrally formed on upper and lower housing portions 164 and 162, respectively.

Web portion 180 of normally open contact strip 176 engages upper first wall 198, and the lower end of first leg portion 192 of normally open contact strip 176 engages lower wall 200. Second leg portion 194 of normally open contact strip 176, however, has a lower free end 214 which engages lower wall portion 212 of fourth wall 204 and which is spaced above lower second wall 200.

Second leg portion 194 is a flexible leg portion and is constructed so that it is flexed upon insertion of a wire between first and second leg portions 192 and 194. As second leg portion 194 is flexed upon insertion of a wire, such as wire 196, between legs 192 and 194, lower free end 214 thereof slides downwardly along lower second portion 212 of fourth wall 204 toward lower second wall 200.

Lower portion 216 of second leg portion 194 is arcuate in cross section and has a convex side 218 facing first leg portion 192. First leg portion 192 has a planar part 220 which is adjacent and offset toward arcuate portion 216 of second leg portion 194.

When a wire is inserted between first and second leg portions 192 and 194, it is engagingly gripped between convex side 218 of arcuate portion 216 of second leg portion 194 and planar part 220 of first leg portion 192. As already noted, such a wire 196 is illustrated in FIG. 10 as engaged with normally open contact strip 176.

As wire 196 is inserted between first and second leg portions 192 and 194, first leg portion 192 remains relatively fixed, since its lower end engages lower second wall 200, and the arcuate cross-sectional portion 216 of second leg portion 194 flexes by flattening the arc thereof. This causes second leg portion 194 to be resiliently biased against wire 196 so that it pushes against the wire and accordingly pushes the wire against planar part 220 of first leg portion 192.

Due to the large flat area of planar part 220, a large area of electrical contact is provided between wire 196 and first leg portion 192.

Additional electrical contact is provided by an inwardly directed shoulder 224 adjacent each wire receiving web opening 182. Each shoulder 224 extends substantially perpendicularly inwardly from one of first and second leg portions 192 or 194. As illustrated herein, shoulders 224 extend from second leg portion 194, but it will be seen that shoulders 224 could extend equally well from first leg portion 192.

Referring now to FIG. 11, each shoulder 224 is formed by punching the shoulder from the flat upper portion of second leg portion 194. In this way, a window 226 is formed in second leg portion 194. Window 226 has no function other than being the result of the formation of shoulder 224. Each shoulder 224 is spaced from, and generally faces, free end 190 of each tab 184 in all of the contact strips. When a wire, such as wire 196, is inserted through wire receiving web opening 182, the wire is placed in contact with shoulder 224, thus increasing the area of electrical contact between the wire and the contact strip.

Each of normally open and normally closed contact strips 176 and 178 has a transverse slot 228 defined in second leg portion 194 thereof. This is illustrated for normally closed contact strip 178 in FIG. 11. Slot 228 is disposed longitudinally between the pair of wire receiving web openings 182. Slot 228 thus divides each arcuate portion 216 of second leg portion 194 into two different sections. These sections thus may flex separately to compensate for varying thicknesses of wire size inserted into wire receiving web openings 182.

Each of first and second common contact strips 172 and 174 has only one wire receiving web opening 182 disposed therein, as best seen in FIG. 9. However, each of first and second common contact strips 172 and 174 also has a slot 230 therein, similar to slot 228 and the other contact strips. Slot 230 is shown in strip 172 in FIG. 10. It will be seen that slot 230 thus divides arcuate portions 216 of second leg portions 194 of first and second contact strips 172 and 174 into two different sections. One of these sections thus may flex separately from the other to receive a wire inserted in wire receiving web opening 182 in the corresponding common contact strip. The other section of arcuate portion 216 of second leg portion 194 of first and second contact strips 172 and 174 is adapted to receive first and second prongs 232 and 234 therein, respectively. In other words, first prong 232 is received between first and second leg portions 192 and 194 of first common contact strip 172 at a position spaced from wire receiving web opening 182 therein, and second prong 234 is similarly received between first and second leg portions 192 and 194 of second common contact strip 174. It will be seen that slots 230 in contact strips 172 and 174 thus allow for variations in the size of prongs 232 and 234 and any wires engaged with contact strips 172 and 174.

Prongs 232 and 234 engage contact strips 172 and 174, respectively, from below and are disposed through holes 236 and 238, respectively, through a downwardly extending, tapered protrusion or protruded portion 240 which is preferably integrally formed on lower housing portion 162. As seen in FIGS. 10 and 11, protrusion 240 has downwardly extending, tapered walls all around it. As will be more fully explained hereinafter, protrusion 240 is dimensioned to closely fit within socket 112 on junction box 14.

Referring again to FIG. 8, upper housing portion 164 has two wire receiving external sockets 242 and 244, each of which is substantially identical in construction and substantially similar to sockets 104, 106, 108, 110, 112 and 114 in junction box 14. Socket 242 is shown in cross section in FIG. 10, and the following description of socket 242 is applicable to each of sockets 242 and 244.

Sockets 242 is constructed for use with a cable such as first switch cable 20 shown in FIGS. 1 and 10. Both cables 20 and 22 are three-wire conductors having wire 196, already discussed, and wires 246 and 248.

Socket 242 is defined by a side wall 250 which is convergingly tapered toward the bottom of the socket. Tapered side wall 250 wedgingly engages outer casing 252 of cable 20. At the bottom of socket 242 are first, second and third aligned housing openings 254, 256 and 258, respectively, disposed therethrough. Housing openings 254, 256 and 258 are in registry with one V-shaped notch 260 of normally open contact strip 176, one V-shaped notch 260 of normally closed contact strip 178, and the V-shaped notch 262 of first common contact strip 172, respectively, as shown in FIG. 9. Similarly, the three housing openings in socket 244 are in registry with the other V-shaped notches 260 in normally open and normally closed contact strips 176 and 178 and the V-shaped notch 260 in second common contact strip 174 as can be readily determined by a comparison of FIGS. 8 and 9.

Socket 242 further includes first and second tapered mid walls 264 and 266, respectively. The tapered walls in socket 242 are thus also adapted to receive an inner insulating sheath, such as 268 which is shown wedgingly engaged with tapered mid wall 264 and tapered side wall 250. A study of FIG. 10 will show that each of housing openings 254, 256 and 258 has adjacent tapered walls for wedging engagement of similar insulating sheaths 270 and 272.

When cable 20 is inserted into socket 242, it is very snugly held therein through a combination of the already described resilient gripping action of strips 176, 178 and 172 on wires 196, 246 and 248, respectively, in combination with the wedging action of casing 252 within tapered side wall 250, and the wedging action of inner sheaths 268, 270 and 272, between the other tapered walls.

Referring once again to FIG. 8, each housing opening, such as housing openings 254, 256 and 258 has associated therewith a substantially square or rectangular opening such as 273, 275 and 277, respectively. Square openings 273, 275 and 277 extend through upper housing portion 164 of adapter 12 and provide access for a tool to engage resilient tabs 184 near their fixed ends 188, so that the resilient tabs may be deflected downwardly to release the respective wires received through openings 254, 256 and 258. Openings 273, 275 and 277 are substantially identical to those shown in junction box 14 used for a similar purpose.

Referring again to FIGS. 1 and 2, it will be seen that adapter 12 is adapted to be plugged into socket 112 of junction box 14. Prongs 232 and 234 are spaced from one another sufficiently and sized appropriately such that they will fit through housing openings 274 and 276 of socket 112. It will thus be seen, referring also to FIG. 3, that prongs 232 and 234 are thus engaged by V-notches 278 and 280 of power contact strip 42 and switched power strip 46, respectively, in junction box 14. In other words, prong 232 and thus first common contact strip 172 in adapter 12 are in electrical communication with power contact strip 42 in junction box 14, and similarly, prong 234 and second common contact strip 174 in adapter 12 are in electrical communication with switched power strip 46 in junction box 14.

When adapter 12 is so engaged with socket 112 of junction box 14, protrusion 240 will be in close relationship to the side walls of socket 112 which, in addition to the gripping engagement of prongs 232 and 234 by contact strips 42 and 46, respectively, helps to locate and properly position adapter 12 with respect to junction box 14. In this position, the lower surface of lower housing portion 162 of adapter 12 will be adjacent the upper end of upper housing portion 30 of junction box 14.

Three-way switches 16 and 18 are illustrated in FIG. 1 to be of a type similar to adapter 12 and junction box 14. That is, switches 16 and 18 have at least one wire receiving socket 282 and 284, respectively, therein for receiving three wire conductors such as first and second switch cables 20 and 22. Such a switch configuration is disclosed in copending U.S. patent application Ser. No. 939,189, a copy of which is incorporated herein by reference. Although this particular plug-in type switch configuration is illustrated herein, it is to be understood that the system and adapter of the present invention may also be utilized with more conventional switch configurations. That is, adapter 12 and junction box 14 may be wired to previously known three-way switches, and the invention is not intended to be limited to the particular configuration of switches 16 and 18 shown in FIG. 1.

Figure 12:
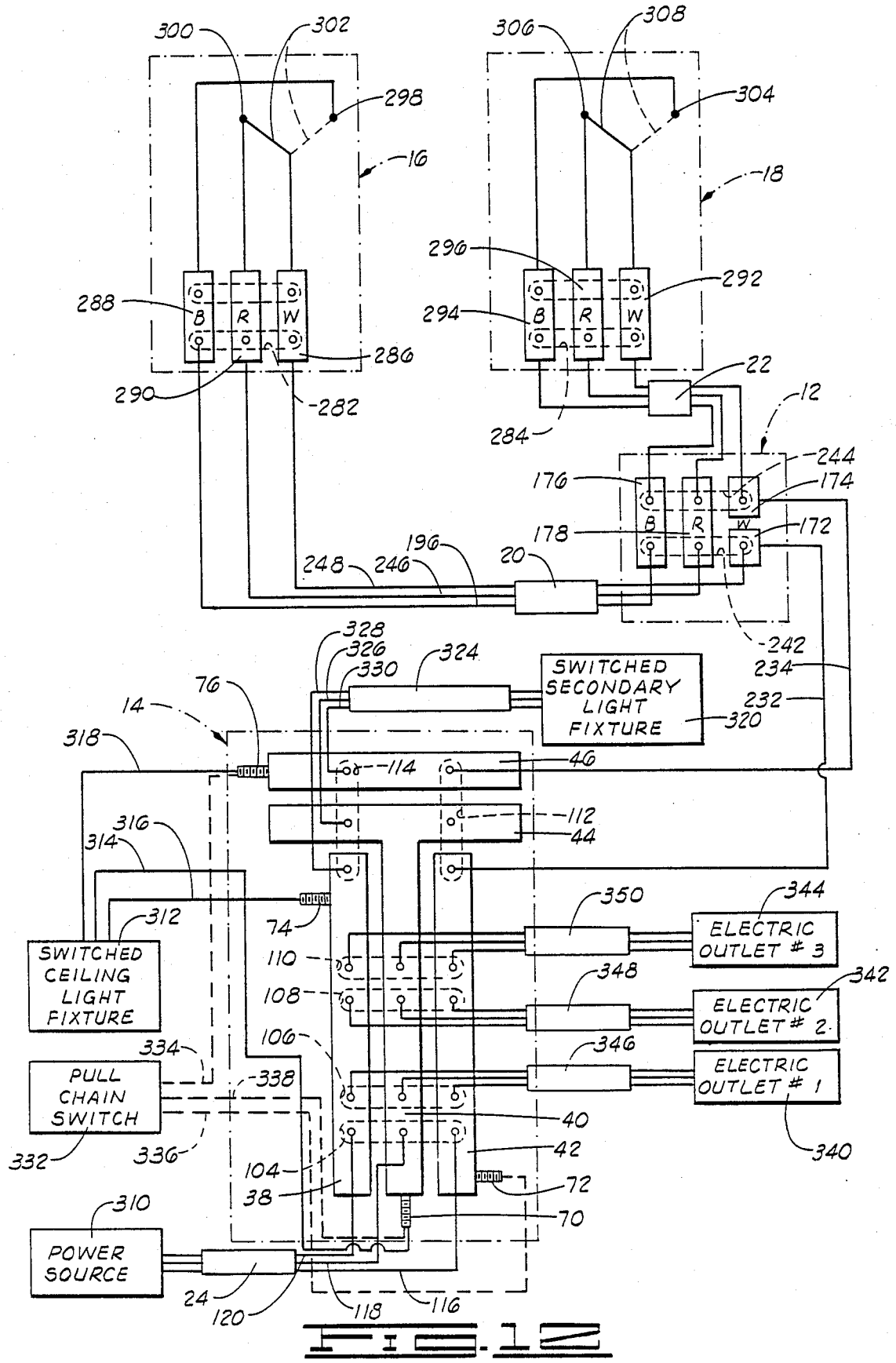
FIG. 12 illustrates a wiring schematic of the three-way switch wiring system.

Referring now to FIGS. 1 and 12, the wiring of system 10 will be discussed. FIG. 12 is a schematic illustration of system 10 utilizing adapter 12, junction box 14, and first and second three-way switches 16 and 18.

The circuitry of adapter 12 is represented by the schematic illustration of contact strips 172, 174, 176 and 178, oriented in a manner corresponding to that in FIG. 9.

The circuitry of junction box 14 is represented by the schematic illustration of contact strips 38, 40, 42, 44 and 46, oriented in a manner corresponding to that seen in FIG. 3.

The circuitry of first three-way switch 16 is represented by the schematic illustration of a common contact strip 286, a normally open contact strip 288 and a normally closed contact strip 290. Similarly, the circuitry of second three-way switch 18 is represented by the schematic illustration of a common contact strip 292, a normally open contact strip 294 and a normally closed contact strip 296.

Schematically, switch 16 has a normally open pole 298, a normally closed pole 300 and a movable switch element 302. Similarly, switch 18 is shown schematically to have a normally open pole 304, a normally closed pole 306 and a movable switch element 308. Normally open pole 298 is in electrical communication with normally open contact strip 288, normally closed pole 300 is in electrical communication with normally closed contact strip 290, and switch element 302 is always in electrical communication with common contact strip 286 in switch 16. Similarly, in switch 18, normally open pole 304 is in electrical communication with normally open contact strip 294, normally closed pole 306 is in electrical communication with normally closed contact strip 296, and switch element 308 is always in electrical communication with contact strip 292.

It should be understood that the notations "normally open" and "normally closed" are used basically just for identification purposes. As will be discussed further herein, the switch element in either switch may be moved to selectively "open" or "close" either pole.

Sockets 104, 106, 108, 110, 112 and 114 in junction box 14, sockets 242 and 244 in adapter 12, socket 282 in switch 16, and socket 284 in switch 18 are designated in FIG. 12 by dashed oval lines generally corresponding to the outer circumference of each of the sockets. The contact between the wires and the corresponding contact strips are represented in FIG. 12 by small circles. Terminals 70, 72, 74 and 76 on junction box 14 are also shown schematically as extending from the corresponding contact strips. An electrical power source 310 is schematically shown near the bottom of FIG. 12. Power cable 24, with its wires 116, 118 and 120, connects power source 310 to junction box 14 at socket 104. In this case, wire 116 is a power wire 116 connected to power contact strip 42, wire 118 is a ground wire 118 connected to ground contact strip 40, and wire 120 is a common or neutral wire 120 connected to a common or neutral contact strip 38.

Adapter 12 is plugged into socket 112 of junction box 14 as already described. Prongs 232 and 234 are represented by lines 232 and 234 in FIG. 12. First common terminal 172 of adapter 12 is thus shown to be in electrical communication with power contact strip 42 of junction box 14, and second common contact strip 174 of adapter 12 is shown to be in electrical communication with switched power strip 46 in junction box 14.

One end of cable 20 is plugged into socket 242 of adapter 12, and the other end of cable 20 is plugged into socket 282 of first switch 16. Thus, wire 196 provides electrical communication between normally open contact strip 176 in adapter 12 and normally open contact strip 288 in switch 16. Wire 246 provides electrical communication between normally closed contact strip 178 in adapter 12 and normally closed contact strip 290 in switch 16. Wire 248 provides electrical communication between first common contact strip 172 in adapter 12 and common contact strip 286 in switch 16. It will be clear to those skilled in the art that common terminal 286 in switch 16 is thus always in electrical communication with power contact strip 42 in junction box 14.

In a similar manner, one end of cable 22 is plugged into socket 244 of adapter 12, and the other end of cable 22 is plugged into socket 284 in second switch 18. Normally open contact strip 176 in adapter 12 and normally open contact strip 294 in switch 18 are thus in electrical communication. Normally closed contact strip 178 in adapter 12 is in electrical communication with normally closed contact strip 294 in switch 18. Second common contact strip 174 in adapter 12 is in electrical communication with common contact strip 292 in switch 18. It will also be clear to those skilled in the art that common contact strip 292 in switch 18 is thus always in electrical communication with switched power strip 46 in junction box 14.

The normally open, normally closed, and common contact strips in adapter 12 and switches 16 and 18 are also identified by the letters "B", "R", "W", respectively, which correspond to the insulation colors of cables 20 and 22. These letters may be imprinted on the adapter and switch housings.

If plug-in switches 16 and 18 are not used, it will be seen by those skilled in the art that wires 196, 246 and 248 of cable 20 may be wired to the screw terminals of any conventional three-way switch, and the wires in cable 22 may also be so connected to another conventional three-way switch.

A switched ceiling light fixture 312 may be connected to junction box 14 by a ground wire 314 connected to ground terminal 70, along with common or neutral wire 316 and power wire 318, respectively, connected to terminals 72 and 76, respectively.

It will be seen by those skilled in the art that with switch elements 302 and 308 in switches 16 and 18, respectively, in the normally closed position shown in FIG. 12, that switched ceiling light fixture 312 will be on. By either moving switch element 302 or 308 to the position shown in dashed lines in FIG. 12, light 312 will be turned off. When both switch elements 302 and 308 are in the position shown by the dashed lines in FIG. 12, the light will again be on, and can be turned off by moving either of the switch elements back to the position shown in solid lines. Thus, three-way switches 16 and 18 by virtue of their connection to junction box 14 by adapter 12, provide three-way switching control of switched ceiling light fixture 312.

A switched secondary light fixture 320 may also be connected to junction box 14 by a cable 324. One end of cable 324 is plugged into socket 114 of junction box 14 such that a ground wire 326 of cable 324 is in electrical communication with ground extension contact strip 44, a common or neutral wire 328 is in electrical communication with common or neutral contact strip 38, and a power wire 330 is in electrical communication with switched power strip 46. It will be seen that switched secondary light fixture 320 is thus wired to junction box 14, and thus to adapter 12 and switches 16 and 18, in a manner essentially identical to switched ceiling light fixture 312. In other words, switches 16 and 18 also provide three-way control of switched secondary light fixture 320.

It will be obvious to those skilled in the art that an electrical outlet rather than a switched secondary light fixture 320 could also be connected to socket 114 of junction box 14 for three-way control by switches 16 and 18.

A pull chain switch 332 may also be connected to the three-way switch circuitry by connecting wires 334 and 336 to terminals 76 and 72, respectively, and connecting wire 338 to terminal 70.

In addition to the above-described three-way switch controlled circuitry, additional electrical components, such as first electric outlet 340, second electric outlet 342 and third electrical outlet 344 by plugging corresponding cables 346, 348 and 350 connected thereto into sockets 106, 108 and 110, respectively, of junction box 14. These electrical outlets or receptacles may be of conventional construction or have a plug-in arrangement as shown in copending U.S. patent application Ser. No. 939,188, incorporated herein by reference. It will be seen that electric outlets 340, 342 and 344 are thus placed in direct electrical communication with power source 310, and the electrical outlets are not affected in any way by switches 16 and 18. It will also be obvious that any other electrical component, and not just electric outlets, may be plugged into any of sockets 106, 108 and 110.

It will be seen that three-way switch wiring system 10 may provide three-way switched control of a variety of electrical components, as well as still providing easy connection of non-switched components. Thus, the electrical wiring system 10 of the present invention and adapter 12 thereof are well adapted to attain the ends and advantages mentioned as well as those inherent therein. While a presently preferred embodiment of the apparatus is described for the purposes of this disclosure, numerous changes in the arrangement and construction of parts may be made by those skilled in the art. All such changes are encompassed within the scope and spirit of the appended claims.

What is claimed is:

1. An adapter for interconnecting a junction box and a pair of three-way switches, said adapter comprising:

an insulating housing defining a plurality of sets of wire receiving housing openings disposed through one wall thereof;

a first common electrical contact strip disposed in said housing and having a wire receiving strip opening therein in registry with a wire receiving housing opening of one of said sets of wire receiving housing openings;

a second common electrical contact strip disposed in said housing and having a wire receiving strip opening therein in registry with a wire receiving housing opening of the other of said sets of wire receiving housing openings;

a first switch electrical contact strip disposed in said housing and having a plurality of wire receiving strip openings in registry with a corresponding wire receiving housing opening of each of said sets of wire receiving housing openings;

a second switch electrical contact strip disposed in said housing and having a plurality of wire receiving strip openings in registry with a corresponding wire receiving housing opening of each of said sets of wire receiving housing openings;

first strip engaging means in electrical communication with said first common electrical contact strip and extending through another wall of said housing for engaging an electrical contact strip in said junction box; and second strip engaging means in electrical communication with said second common electrical contact strip and extending through the same wall as said first strip engaging means for engaging another electrical contact strip in said junction box.

2. The adapter of claim 1 wherein said first and second strip engaging means are characterized by a pair of spaced elongated prongs.

3. The adapter of claim 1 wherein each of said common and switch contact strips comprises:

a middle web portion through which the corresponding wire receiving strip opening is disposed; and first and second leg portions extending away from said web portion, said leg portions being arranged for grippingly receiving wire therebetween.

4. The adapter of claim 3 wherein:

said first and second strip engaging means are characterized by a pair of elongated prongs; and said first and second leg portions of said first and second common contact strips are further arranged for grippingly receiving an end of the corresponding prongs therebetween.

5. The adapter of claim 4 wherein:

each prong is spaced from the wire receiving strip opening in the corresponding common contact strip; and one of said leg portions in each of said common contact strips defines a transverse slot therein between each corresponding prong and wire receiving strip opening.

6. The adapter of claim 1 wherein said first and second common electrical contact strips are substantially parallel.

7. The adapter of claim 1 wherein said first and second switch electrical contact strips are substantially parallel.

8. The adapter of claim 1 wherein said first and second common electrical contact strips are substantially perpendicular to said switch electrical contact strips.

9. The adapter of claim 1 wherein:

said housing defines a plurality of sockets in said one wall; and each set of said wire receiving housing openings is disposed in a corresponding one of said sockets.

10. The adapter of claim 1 wherein each of said sets of wire receiving housing openings is an aligned set of wire receiving housing openings.

11. The adapter of claim 1 wherein:

said junction box defines a socket therein; and said housing has a protrusion thereon adjacent said first and second strip engaging means and adapted for positioning in said socket in said junction box when said first and second strip engaging means engage said contact strips in said junction box.

12. A three-way switch circuit comprising:

a wiring apparatus comprising:

a first power contact strip adapted for receiving a first wire from a power cable;

a second power contact strip spaced from said first power contact strip; and a neutral contact strip adapted for receiving a second wire of said power cable; and an adapter comprising:

a first common contact strip adapted for receiving a wire from a common terminal of a first three-way switch;

a second common contact strip adapted for receiving a wire from a common terminal of a second three-way switch;

a normally open switch contact strip adapted for receiving a wire from normally open terminals of each of said first and second switches;

a normally closed contact strip adapted for receiving a wire from normally closed terminals of each of said first and second switches;

first strip engaging means for providing electrical communication between said first power contact strip and said first common contact strip; and second strip engaging means for providing electrical communication between said second power contact strip and said second common contact strip.

13. The circuit of claim 12 wherein:

said first strip engaging means is characterized by a first elongated prong adapted to extend from said first common contact strip through a wire receiving strip opening defined in said first power contact strip; and said second strip engaging means is characterized by a second elongated prong adapted to extend from said second common contact strip through a wire receiving strip opening defined in said second power contact strip.

14. The circuit of claim 13 wherein:

said wiring apparatus further comprises an insulating housing defining a recessed socket therein with wire receiving housing openings therethrough in registry with said wire receiving strip openings; and said adapter further comprises an insulating housing having a protruded portion thereon adjacent said prongs, said protruded portion being adapted to extend into said socket when said prongs extend through said wire receiving strip openings for engagement with said first and second power contact strips.

15. The circuit of claim 12 wherein:

each of said first and second common contact strips defines a wire receiving strip opening therein; and each of said normally open and normally closed switch contact strips defines at least a pair of wire receiving strip openings therein.

16. The circuit of claim 15 wherein:

said wire receiving strip opening in said first common contact strip is aligned with one of said wire receiving strip openings in each of said normally open and normally closed switch contact strips; and said wire receiving strip opening in said second common contact strip is aligned with the other of said wire receiving strip openings in each of said normally open and normally closed contact strips.

17. The circuit of claim 15 wherein said adapter further comprises an insulating housing defining a plurality of wire receiving housing openings therein adapted for receiving said wires from said switches therethrough, each wire receiving housing opening being in registry with a wire receiving strip opening.

18. The circuit of claim 17 wherein said housing further defines:

a first socket adjacent the housing openings corresponding to said wire receiving strip openings in said first common contact strip and one of said wire receiving strip openings in said normally open and normally closed contact strips; and a second socket adjacent the housing openings corresponding to said wire receiving strip opening in said second common contact strip and the other of said wire receiving strip openings in said normally open and normally closed contact strips.

19. The circuit of claim 18 wherein said sockets are dimensioned for wedging engagement with an outer insulating sheath of a three-wire cable.

20. A three-way switch circuit comprising:

a junction box comprising:

an insulating box housing defining a plurality of wire receiving housing openings therein;

a first power contact strip disposed in said box housing and defining a plurality of wire receiving strip openings therein, each in registry with a wire receiving housing opening in said box housing;

a second power contact strip disposed in said box housing and defining a plurality of wire receiving strip openings therein, each in registry with a wire receiving housing opening in said box housing;

a neutral contact strip disposed in said box housing and defining a plurality of wire receiving strip openings therein, each in registry with a wire receiving housing opening in said box housing; and a ground contact strip disposed in said box housing and defining a plurality of wire receiving strip openings therein, each in registry with a wire receiving housing opening in said box housing;

an adapter comprising:

an insulating adapter housing defining a plurality of wire receiving housing openings therein;

a first common contact strip disposed in said adapter housing and defining a wire receiving strip opening therein in registry with a wire receiving housing opening in said adapter housing;

a second common contact strip disposed in said adapter housing and defining a wire receiving strip opening therein in registry with a wire receiving housing opening in said adapter housing;

a normally open switch contact strip disposed in said adapter housing and defining a pair of wire receiving strip openings therein, each in registry with a wire receiving housing opening in said adapter housing;

a normally closed switch contact strip disposed in said adapter housing and defining a pair of wire receiving strip openings therein, each in registry with a wire receiving housing opening in said adapter housing;

a first elongated prong in electrical communication with said first common contact strip and extending from said adapter housing, said first prong being engageable with said first power contact strip in said junction box; and a second elongated prong in electrical communication with said second common contact strip and extending from said adapter housing, said second prong being engageable with said second power contact strip in said junction box;

a first three-way switch having a common contact, a normally open contact and a normally closed contact;

a second three-way switch having a common contact, a normally open contact and a normally closed contact;

a first switch cable comprising:

a first wire for providing electrical communication between said common contact of said first three-way switch and said wire receiving strip opening in said first common contact strip of said adapter;

a second wire for providing electrical communication between said normally open contact of said first three-way switch and one of said wire receiving strip openings in said normally open contact strip of said adapter; and a third wire for providing electrical communication between said normally closed contact of said first three-way switch and one of said wire receiving strip openings in said normally closed contact strip of said adapter; and a second switch cable comprising:

a first wire for providing electrical communication between said common contact of said second three-way switch and said wire receiving strip opening in said second common contact strip of said adapter;

a second wire for providing electrical communication between said normally open contact of said second three-way switch and the other of said wire receiving strip openings in said normally closed contact strip of said adapter; and a third wire for providing electrical communication between said normally closed contact strip of said second three-way switch and the other of said wire receiving strip openings in said normally closed contact strip of said adapter.

21. The circuit of claim 20 wherein:

one of said wire receiving strip openings in said first power contact strip is aligned with one of said wire receiving strip openings in said second power contact strip;

said box housing defines a socket therein adjacent the wire receiving housing opening corresponding to the aligned wire receiving strip openings; and said adapter housing has a protrusion thereon positionable in said socket when said prongs are engaged with said power contact strips.

22. The circuit of claim 20 wherein:

said wire receiving strip opening in said first common contact strip is aligned with one of said wire receiving strip openings in each of said normally open and normally closed contact strips; and said wire receiving strip opening in said second common contact strip is aligned with the other of said wire receiving strip openings in each of said normally open and normally closed switch contact strips.

23. The circuit of claim 22 wherein said housing further defines:

a first socket adjacent the housing openings corresponding to said wire receiving strip opening on said first common contact strip and said one of said wire receiving strip openings on said normally open and normally closed contact strips; and a second socket adjacent the housing openings corresponding to said wire receiving strip openings on said second common contact strip and said other of said wire receiving strip openings on said normally open and normally closed contact strips.

24. The circuit of claim 23 wherein:

said first and second switch cables further comprise an outer insulating sheath;

said first socket is dimensioned for wedging engagement with said outer insulating sheath of said first switch cable; and said second socket is dimensioned for wedging engagement with said outer insulating sheath of said second switch cable.

25. The circuit of claim 20 wherein each of said three-way switches comprises:

an insulating switch housing defining a plurality of wire receiving housing openings therein;

a common switch contact strip disposed in said switch housing and defining a plurality of wire receiving strip openings therein, each in registry with a wire receiving housing opening in said switch housing, said common switch contact strip forming said common contact;

a normally open switch contact strip disposed in said switch housing and defining a wire receiving strip opening therein in registry with a wire receiving housing opening in said switch housing, said normally open switch contact strip forming said normally open contact; and a normally closed switch contact strip disposed in said switch housing and defining a wire receiving strip opening therein in registry with a wire receiving housing opening in said switch housing, said normally closed switch contact strip forming the normally closed contact.

26. The circuit of claim 25 wherein:

the wire receiving housing openings in said switch housing are aligned; and each switch housing defines a socket therein adjacent the aligned wire receiving housing openings in said switch housing.

* * * * *